United States Patent [19]

Slavin et al.

[11] 4,419,641

[45] Dec. 6, 1983

[54] SOLENOID

[75] Inventors: Michael Slavin, Troy; Ellsworth S. Miller, Mt. Clemens, both of Mich.

[73] Assignee: Lectron Products, Inc., Rochester, Mich.

[21] Appl. No.: 371,976

[22] Filed: Apr. 26, 1982

[51] Int. Cl.[3] ..... H01F 7/00

[52] U.S. Cl. ..... 335/219; 292/201; 292/216

[58] Field of Search ..... 335/219, 220, 255, 261, 335/262, 270, 279; 292/201, 216

[56] References Cited

U.S. PATENT DOCUMENTS 3,629,747 12/1971 Findley ..... 335/255 X 3,917,330 11/1975 Quantz ..... 292/216

*Primary Examiner*—George Harris

*Attorney, Agent, or Firm*—Harness, Dickey & Pierce

[57] ABSTRACT

A solenoid spool having a Bowden cable connector that is made in two parts which are uniquely formed and related to the solenoid plunger to cover and protect the latter from dirt and other contaminants that adversely affect the operation of the solenoid in use. One part of the connector attached to the cable sheathing is piloted on and detachably fastened to the other part which is attached to and a part of the solenoid bobbin or spool in a way that positions the cable wire precisely automatically at assembly for attachment to the plunger.

5 Claims, 4 Drawing Figures

SOLENOID

BACKGROUND OF THE INVENTION

Typically and by way of example, the latches for deck lids and gas doors of automotive vehicles are actuated through a Bowden cable by means of a solenoid which is mounted on the vehicle frame or body adjacent to the latch mechanism. Manifestly, solenoid and Bowden cable sub-assemblies adapted for these uses are mass produced, and it is important to be able to assemble the cable easily and expeditiously with the solenoid.

Heretofore, the usual practice has been to enclose the spool on which the solenoid electromagnetic coil is wound in a metal housing that is formed with mounting brackets which are provided with preformed holes that permit the assembly to be riveted or otherwise fastened to the vehicle. In these types of solenoids, the solenoid plunger normally extends from one end of the coil, and a suitable connector attached to the sheathing of the Bowden cable actuator is adapted to be attached to a mounting bracket on the housing that positions the free end of the cable wire properly for attachment to the extending end of the plunger so that retraction of the plunger into the spool by energization of the coil slidably actuates the wire to operate a latch attached to its other end. In order to permit quick and easy attachment of the connector to its mounting bracket, the bracket conventionally is formed with an open-ended slot that receives and interfits with the connector, and the latter is then riveted or otherwise fixedly secured to the bracket. The problem with this arrangement is that the mounting brackets sometimes become bent or otherwise damaged during manufacture or shipment of the solenoid so that, when the Bowden cable is attached to the bracket, the latch actuating wire of the cable does not align properly with the solenoid plunger. When this happens, the misalignment causes the interconnected parts to bind or it may even be necessary to straighten the bracket in order to connect the cable wire to the plunger. The latter contingency is a time consuming and therefore expensive manual operation. Moreover, this mode of attaching the Bowden cable to the solenoid leaves the projecting end of the solenoid plunger exposed so that rod dust, grit and other contaminants have access to it and to the space between the plunger and the bore of the spool in which it moves which causes the plunger to stick or otherwise become non-functional in use.

SUMMARY OF THE INVENTION

The present invention uses a different mode of attachment for the Bowden cable that obviates the alignment problem referred to above thereby making it easier to assemble the cable on the solenoid. In addition, the cable attaching means of this invention provides a cover for the extending portion of the solenoid plunger so as to protect it from dirt and other contaminants that heretofore have caused operational problems in use.

DESCRIPTION OF THE PREFERRED EMBODIMENT

Figure 1:
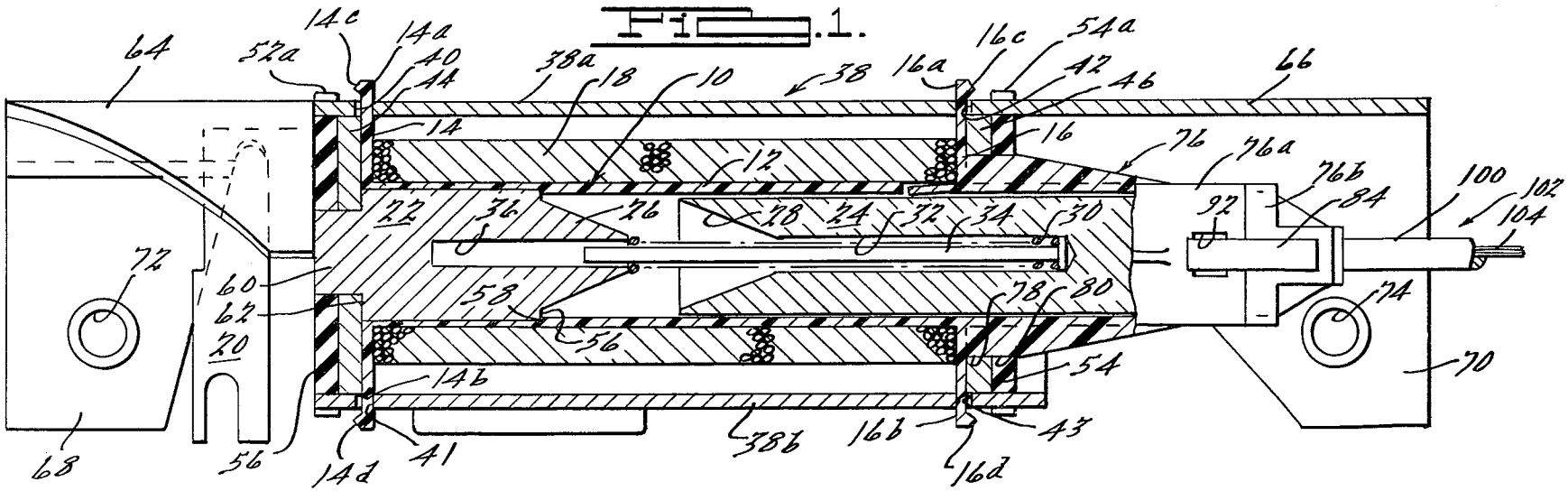
FIG. 1 is a top plan view of a solenoid and Bowden cable sub-assembly embodying the novel connector of this invention and showing the solenoid and part of the connector broken away for clearness of illustration.

In the drawing, the numeral 10 designates the solenoid spool or bobbin which is conventionally made of a suitable plastic resin or other non-magnetic material. The main body of the spool 10 here shown by way of illustration has the usual center tubular core 12 and radially extending, integral flanges 14 and 16 at opposite ends thereof. The wire coil or winding 18 is wrapped around the core 12 between the end flanges 14 and 16, and the ends of the coil are connected to an electrical terminal 20 mounted at one end of the spool 10 in the conventional manner. A fixed plug 22 is mounted in one end of the core 12, and the solenoid plunger 24 is mounted in the core for axial sliding movement at the other end of the spool 10 with a portion of the plunger normally extending from one end of the spool as shown in FIG. 1. A frustoconical member 26 on the inner end of the plug 22 is adapted to be received in a correspondingly shaped recess 28 in the adjacent end of the plunger 24 when the latter is retracted into the spool by energization of the coil 18. A helical spring 30 is disposed in a central bore 32 that extends into the plunger 24 from the recess 28, and the opposite ends of the spring seat against the bottom of the bore 32 and the end of the frustoconical member 26 so as to hold the spring normally compressed to urge the plunger normally at the limit of its travel to the left, as viewed in FIG. 1. In this position of the plunger 24, it is spaced axially from the fixed plug 22 and the right hand terminal portion thereof extends beyond the end flange 16 of the spool 10 (FIG. 1). A guide pin 34 disposed centrally within the bore 32 and the spring 30 extends into an aligned socket 36 in the plug 22 to control and guide axial movement of the plunger 24 in the core 12. When the coil 18 is energized, the plunger 24 is pulled to the left, as viewed in the drawing, against the action of the spring 30 until it seats against the plug 22 and, when the coil is deenergized, the spring returns the plunger to its normal extended position.

Figure 3:
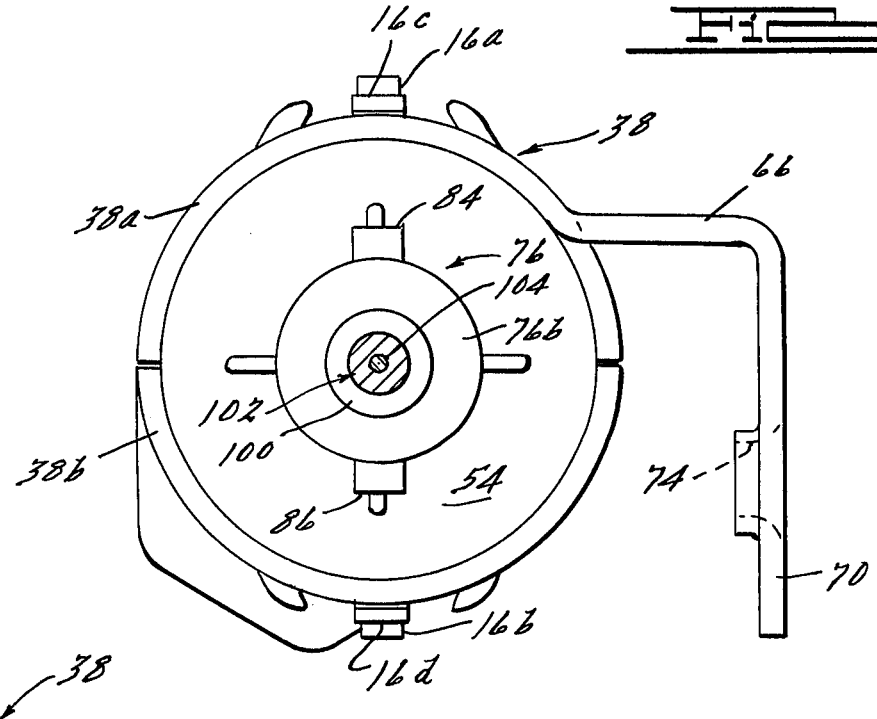
FIG. 3 is a transverse, sectional view taken on the line 3—3 of FIG. 1.
Figure 4:
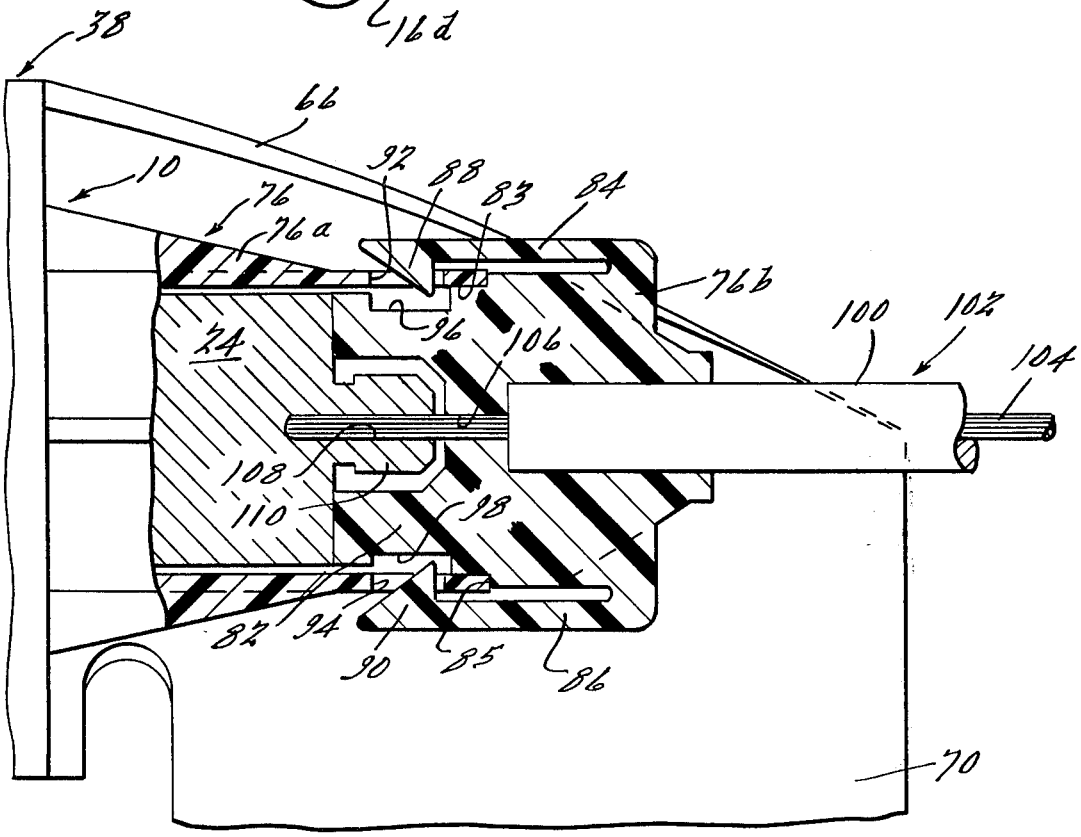
FIG. 4 is an enlarged view of the portion of FIG. 2 enclosed in the circle 4.

The solenoid is here shown mounted in a tubular housing 38 according to conventional practice, and the housing is divided longitudinally into two parts **38*a* and 38*b* to facilitate assembly of the solenoid therein. As perhaps best shown in FIG. 1, th end flanges 14 and 16 of the spool 10 are formed with diametrically opposed, laterally extending arms 14*a*, 14*b* and 16*a*, 16*b*, respectively, that extend through openings 40, 41, 42 and 43 in the housing parts 38*a* and 38*b* when the latter are assembled together, as shown in FIG. 3, and the arms have enlarged wedge shaped end portions 14*c*, 14*d* and 16*c*, 16*d* that comprise snap fasteners which interengage with the housing portions 38*a* and 38*b*** to hold the latter together when the housing is first assembled with the solenoid.

Metal disks 44 and 46 disposed within the housing 38 at the ends of the spool 10 form flux collector rings for the electromagnetic coil 18, and the rings are held securely in the housing by integral, laterally spaced, radially outwardly extending tabs **44*a* and 46*a*, respectively, that project through openings 48 and 50** in the housing.

At the final assembly, the projecting ends of the tabs 44*a* and 46*a* are upset or peened over to fix the flux rings 44 and 46 in place and to fasten the housing sections 38*a* and 38*b* securely together. At the axially outer sides of the flux collector rings 44 and 46 are disk-shaped covers 52 and 54 which preferably are made of a suitable electrically insulating material, and the covers are provided at diametrically opposite sides thereof with radially outwardly extending tabs 52*a* and 54*a* that extend through suitable openings 55 provided in the housing 38 to hold the covers securely in the ends of the housing.

In order to hold the plug 22 fixed in the spool 10 and to enable the plug to withstand the impact forces to which it is subjected when the plunger 24 is retracted by energization of the electromagnetic coil 18, the plug is formed adjacent to the inner end thereof at the base of the frustoconical member 26 with a radial shoulder 56 that engages an annular seat 58 in the spool core 12, and the plug is formed at the outer end thereof with a longitudinal extension 60 of reduced diameter which defines an annular shoulder 62 that seats against the flux collector ring 44. Manifestly, the oppositely facing inner and outer shoulders 56 and 62 mutually cooperate to prevent movement of the plug 22 either axially inwardly or axially outwardly in the spool 10, and the staked tabs 44*a* of the flux collector ring 44 act through the latter to hold the plug fixed and secure in the spool 10.

In order to adapt the solenoid for ready attachment to a suitable support, the housing 38 is formed at opposite ends thereof with longitudinally extending mounting members 64 and 66 that are shaped to define laterally extending, longitudinally aligned brackets 68 and 70, respectively, and the brackets are provided with openings 72 and 74 through which screws or rivets can be inserted to attach the solenoid to any suitable support (not shown). The terminal 20 is here shown attached to the mounting member 64 in the usual way. As suggested, the conventional practice heretofore has been to provide the forward end of the housing 38 with a second mounting bracket (not shown) that was disposed adjacent to and forwardly of the projecting end of the solenoid plunger 24 and adapted for attachment to a Bowden cable by means of a suitable connector carried by the bracket that positioned the cable in longitudinal alignment with the plunger. In practice, the cable sheath was fixed to the connector and the cable wire projecting from the sheath was attached in any suitable or conventional manner to the solenoid plunger. This arrangement functioned satisfactorily but it had the disadvantage of leaving the end of the pluner exposed so that dirt and other contaminants could gain ready access to the space between the plunger and the spool 10. In practice, these contaminants sometimes accumulated in sufficient amount to cause the plunger to stick or otherwise become faulty in operation or even to be immobilized and this, of course, prevented the solenoid from performing its intended function in use. In addition, the Bowden cable bracket frequently became bent or otherwise damaged in manufacture or during shipment so that, when the Bowden cable was connected thereto, it failed to align the Bowden wire properly with the solenoid plunger. If the misalignment was minor, the Bowden wire could still be attached to the solenoid plunger but it exerted a constant lateral pressure against the plunger that caused operational problems. On the other hand, if the misalignment was relatively great, the Bowden wire could not be attached to the solenoid plunger at all without straightening or repositioning the cable bracket, and this more often than not was a difficult and time consuming manual operation that significantly increased the manufacturing cost of the solenoid-Bowden-cable sub-assembly.

According to the present invention, the manufacturing and operational problems resulting from the conventional mode of attachment of the Bowden cable to the solenoid are obviated by mounting the Bowden cable connector directly on the spool 10, as shown in the drawings. In the particular construction here shown by way of illustration, the connector, which is here designated generally by the numeral 76, is formed in two inner and outer parts 76*a* and 76*b*.

The inner connector part 76*a* is of generally tubular configuration and is formed integrally with the forward end of the spool 10. As perhaps best shown in FIG. 1, the inner connector part 76*a* is disposed centrally on the forward end of the spool 10, and it extends longitudinally therefrom through centrally disposed openings 78 and 80 in the front flux collector ring 46 and its associated cover 54. The inner connector part 76*a* surrounds the extending terminal portion of the solenoid plunger 24 and it extends longitudinally beyond the plunger when the latter is in its normal fully extended position shown in the drawing. In order not to interfere with axial sliding movement of the plunger 24 in the spool 10, the inner connector part 76*a* also is spaced circumferentially from the plunger.

Figure 2:
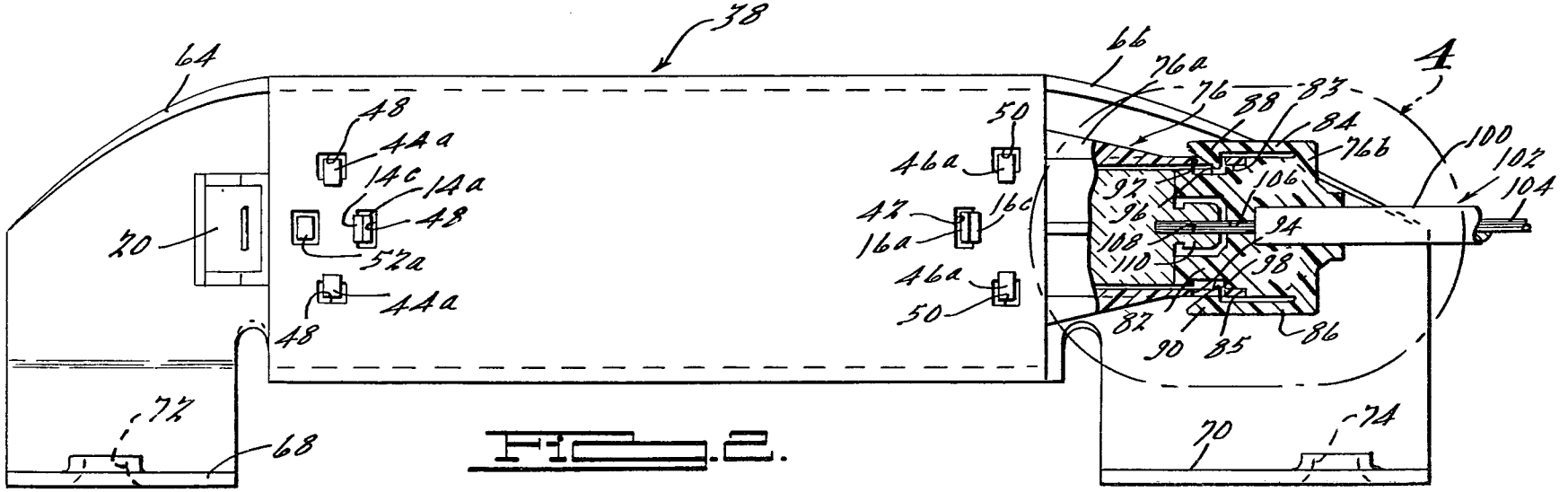
FIG. 2 is a side elevational view of the solenoid and Bowden cable sub-assembly showing the other part of the connector and the terminal portion of the solenoid plunger in section.

The outer connector part 76*b* is adapted to be detachably fastened to the inner connector part 76*a* and to provide a closure for the latter forwardly of the solenoid plunger 24. If the inner connector part 76*a* is formed integrally with the spool 10 as here shown and described, it is molded directly on the spool and is made of the same plastic resin material as the spool. Similarly, the outer connector part 76*b* can be made as a molded part conveniently an inexpensively also of plastic resin material. In any event, the outer connector part 76*b* is formed at the inner end thereof with a longitudinal extension 82 that extends into the inner connector part 76*a* and terminates adjacent to or perhaps in butting relation to the end of the solenoid plunger 24, as shown in FIG. 2. Also, at least a portion of the extension 82 snugly fits the terminal end portion of the inner connector part 76*a* as at 83 so that the outer connector part 76*b* is piloted in the inner connector part and is held by the latter in coaxial relation to and properly aligned with the plunger 24. A rearwardly facing annular shoulder 85 on the outer connector part 76*b* seats against the end of the inner connector part 76*a* to locate and position these parts axially with respect to each other. Rearwardly extending, flexible and resilient, longitudinal arms 84 and 86 formed on the outer connector part 76*b* at diametrically opposite sides thereof overlay the terminal end portion of the inner connector part 76*a*, and enlarged head portions 88 and 90 extend laterally inwardly therefrom through openings 92 and 94 in the inner connector portion 76*a* to fasten the two connector parts 76*a* and 76*b* securely but detachably together. If necessary or desirable, the outer connector part 76*b* may be provided with recesses 96 and 98 that are located so as to align with the openings 92 and 94 when the outer connector part is fully inserted into the inner connector part 76*a*, as shown in the drawings, to accommodate the snap fastener head portions 88 and 90 that extend through and project from the openings 92 and 94.

The sheath 100 of a Bowden cable 102 is fastened securely to the outer connector part 76*b* and, if the latter is molded from plastic resin material as suggested above, it can be molded directly on the sheath so as to be, in effect, an integral part thereof. In any event, the Bowden wire 104 extends beyond the sheath 100, and the projecting portion of the wire extends through and is slidably received by an opening 106 in the outer connector part 76*b*. The portion of the wire 104 that projects from the opening 106 extends into a socket 108 formed in a reduced diameter knob-like member 110 formed centrally on and integrally with the solenoid plunger 24. It will be readily appreciated that the Bowden cable wire 104 conventionally is freely slidable in the sheath 100 and, in practice, the Bowden wire 104 is attached to the solenoid plunger 24 when the latter is removed from the spool 10 by inserting the wire into the socket 108 and crimping the member 110 against the wire so as to provide a fixed and permanent connection therebetween. The plunger 24 is then inserted into the spool 10 and the outer connector part 76*b* is inserted into the inner connector part 76*a* and detachably fastened thereto in the manner hereinabove described.

In connection with the foregoing, it will be readily appreciated that, when the plunger 24 is inserted into the spool 10 through the inner connector part 76*a* to complete the solenoid assembly and the outer connector part 76*b* is detachably fastened to the inner connector part 76*a* to complete the solenoid-Bowden-cable subassembly, the two connector parts 76*a* and 76*b* mutually cooperate, for all practical purposes, to completely enclose the projecting terminal portion of the plunger so as to seal the annular space between the plunger and the spool to prevent dirt and other contaminants from penetrating the space and causing sticking or even freezing of the plunger. Also, mounting of the connector 76 directly on the solenoid spool 10 eliminates the alignment problem inherent in the construction previously used. When the Bowden wire 104 is connected to the solenoid plunger 24 in the manner hereinabove described, the close fitting relation between the two connector parts 76*a* and 76*b* assures a proper and precise coaxial alignment of the plunger and the wire when the plunger is inserted into the spool 10 and the outer connector part is slipped into and detachably fastened to the inner connector part. Since the two connector parts 76*a* and 76*b* are molded directly on or otherwise fixed to the solenoid spool 10 and the Bowden cable 102, respectively, and since the manufacturing operation necessarily holds the interfitting parts to a relatively close tolerance dimension, a precise alignment of the working parts that transmitted motion from the solenoid to the cable is automatically assured and there is little possibility of the cooperating parts being damaged prior to assembly so that one part does not properly fit its mating part at assembly.

While it will be apparent that the invention herein described is well calculated to achieve the benefits and advantages as hereinabove set forth, it will be appreciated that the invention is susceptible to modification, variation and change without departing from the spirit thereof.

Having thus described the invention, we claim:

1. The combination with a solenoid of the type having a bobbin on which an electromagnetic coil is wound and a plunger axially slidable in said bobbin and normally extending axially beyond one end of said coil, and a Bowden cable of the type having an inner axially movable wire and an outer sheath around and supporting said wire, of closure means on and carried by the mentioned end of said bobbin enclosing and slidably accepting and sealing the extending portion of said plunger, and attaching means mounting said Bowden cable on said closure means in coaxial alignment with said plunger with said sheath fixed to and held by said closure means and said wire fixed to and movable with said plunger.

2. A connector for attaching a Bowden cable of the type having an inner, axially movable wire and an outer sheath around and supporting said wire to a solenoid of the type having a bobbin on which an electromagnetic coil is wound and a plunger axially slidable in said bobbin and normally extending axially beyond said one end of said coil, said connector comprising two-part means, on part being connected to said bobbin adjacent to the projecting end of said plunger, and the other part being fixed to said sheath and piloted on said first part to hold said Bowden cable in coaxial relation with respect to said plunger and said wire aligned precisely relative to said plunger for attachment thereto.

3. The combination as set forth in claim 2 wherein said other part is detachably fastened to said one part.

4. The combination as set forth in claim 2 including snap fastener means for detachably connecting said other part to said one part.

5. The combination as set forth in claim 2 wherein said one part is formed integrally with said bobbin, and wherein said other part is detachably fastened to said one part.

* * * * *